United States Patent [19]

Tsukuda

[11] 4,241,535

[45] Dec. 30, 1980

[54] SUBMERSIBLE TOY

[75] Inventor: Mitsuo Tsukuda, Tokyo, Japan

[73] Assignee: Kabushiki Kaisha Tsukuda Hobby, Tokyo, Japan

[21] Appl. No.: 77,745

[22] Filed: Sep. 21, 1979

[30] Foreign Application Priority Data

Feb. 1, 1979 [JP] Japan ..... 54-10791

[51] Int. Cl.[3] ..... A63H 23/04

[52] U.S. Cl. ..... 46/250; 46/94; 46/92

[58] Field of Search ..... 46/250, 94, 92, 91, 46/95, 93; 43/42.22, 42.47, 26.2, 43.13

[56] References Cited

U.S. PATENT DOCUMENTS

| | | | |
|---|---|---|---|
| 2,789,386 | 4/1957 | Creelman | 43/42.22 X |
| 3,010,255 | 11/1961 | Gordon | 43/26.2 X |
| 3,619,938 | 11/1971 | Tong | 46/94 |
| 3,628,286 | 12/1971 | Mashahiro | 46/92 X |
| 3,638,353 | 2/1972 | Fryc et al. | 46/92 |

*Primary Examiner*—Robert Peshock
*Assistant Examiner*—Mickey Yu
*Attorney, Agent, or Firm*—Staas and Halsey

[57] ABSTRACT

A submersible toy comprised of an upper body portion and a watertight lower body portion coupled to said upper body portion, the upper body portion having a first horizontal rudder on the periphery thereof and a float disposed inside thereof, the lower body portion having a motor and a cell disposed inside thereof, a propeller mounted on a rotary shaft of the motor and a vertical and a second horizontal rudder disposed at the rear of the propeller. With this construction, the submersible toy can alternatingly cruise under water and on the surface.

4 Claims, 5 Drawing Figures

SUBMERSIBLE TOY

TECHNICAL FIELD AND BACKGROUND ART

This invention relates generally to a water toy which is played with in the water, and more particularly to a submersible toy capable of cruising under water like a submarine.

Submersible toys heretofore known can cruise only under water and cannot cruise on the surface.

SUMMARY OF THE INVENTION

It is therefore an object of the present invention to provide a toy which is capable of making a cruise, repeating underwater cruising and surface cruising.

In accordance with the present invention, there is provided a submersible toy comprising an upper body portion; a liquid-tight lower body portion; said upper body portion being coupled to said lower body portion through connecting means; a first horizontal rudder provided on said upper body portion; a second horizontal rudder provided on said lower body portion; said first horizontal rudder on the upper body portion being disposed at a position upper than said second horizontal rudder on the lower body portion; a float provided inside said upper body portion; a motor and a cell provided inside said liquid-tight lower body portion; said motor having a rotary shaft which has an extension projected outwardly from a rear portion of said lower body portion; a propeller provided on the extension of the rotary shaft; and a vertical rudder provided on said lower body portion at the rear of said propeller; said second horizontal rudder on the lower body portion being disposed at the rear of said propeller.

PREFERRED EMBODIMENT OF THE INVENTION

Figure 1:
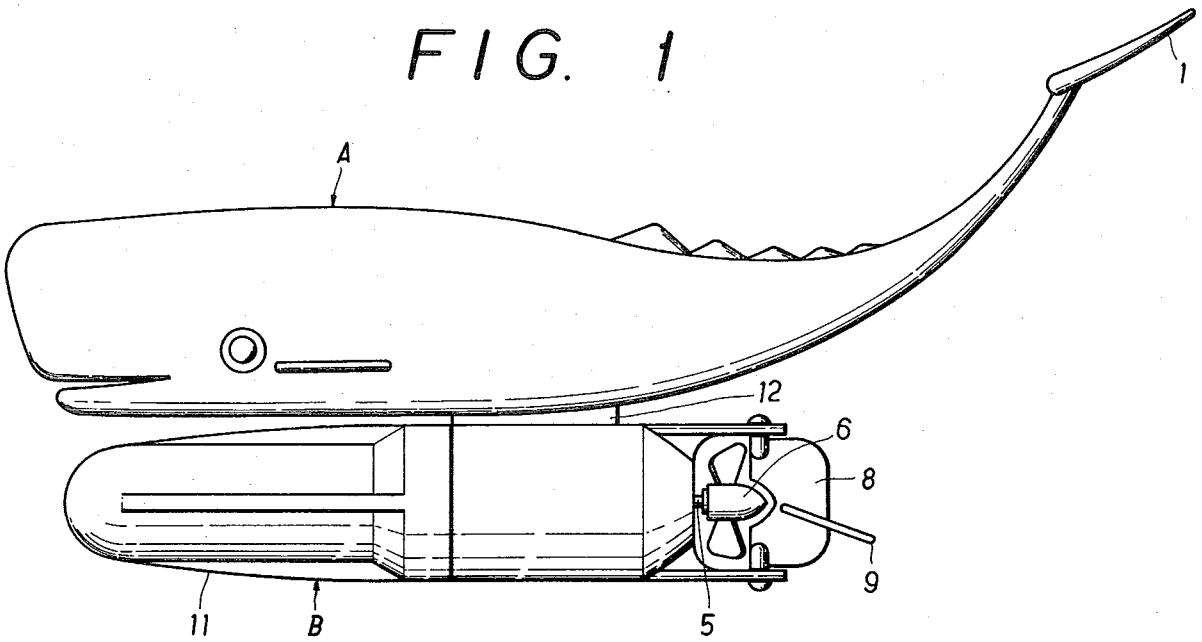
FIG. 1 is a side elevational view of one form of a submersible toy in accordance with the present invention.
Figure 2:
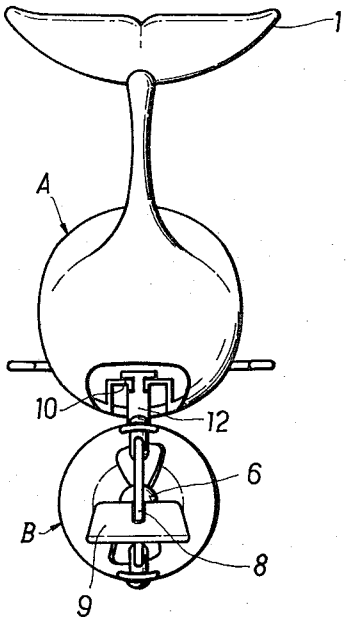
FIG. 2 is a rear view of the submersible toy illustrated in FIG. 1.
Figure 3:
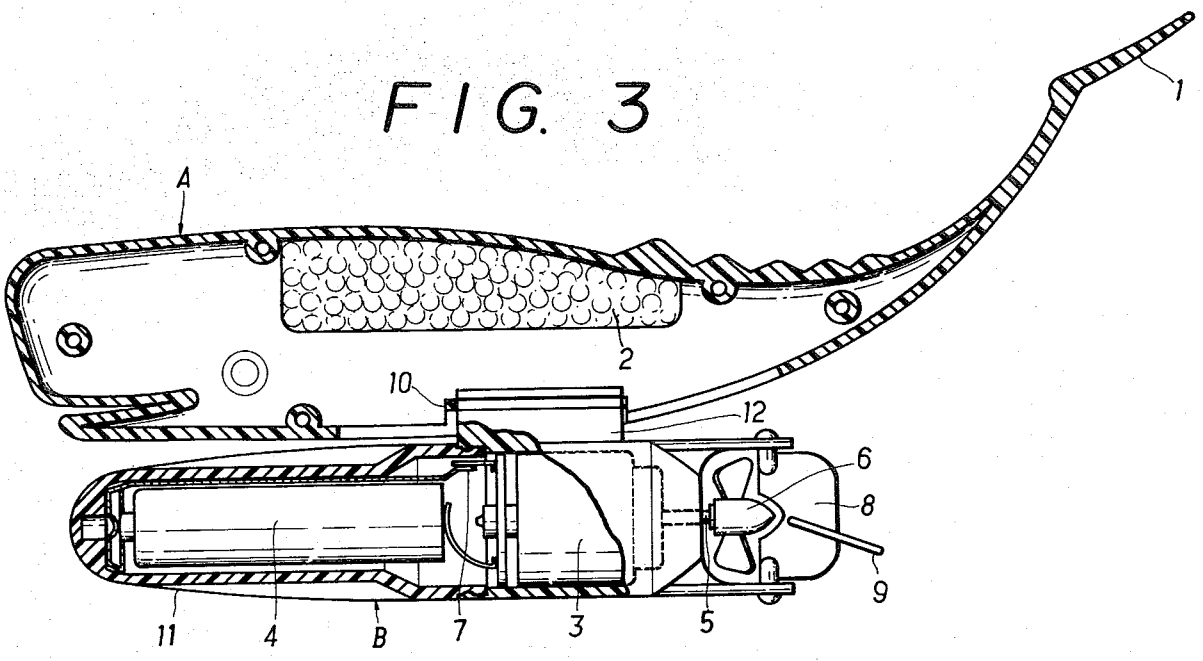
FIG. 3 is a partly sectional view of the submersible toy illustrated in FIG. 1.

Referring now to the drawings, there is illustrated one preferred form of the submersible toy in accordance with the invention. Character A designates an upper body portion and character B a lower body portion. The upper body portion A is formed, for example, in a whale shape as illustrated in FIGS. 1 to 3. A first hydroplane or horizontal rudder is provided on a tail portion of the whale-shaped upper body portion, which is formed at an upper rear portion thereof, and located at a position upper than a second hydroplane or horizontal rudder 9 provided on the lower body portion B. The first horizontal rudder 1 is fixed so as to have a pressure of water on the upper face thereof during cruising under water. The upper body portion A further has a float 2 therein to adjust buoyancy of the submersible toy. The lower body portion B is made watertight and formed generally in a cylindrical shape. A head 11 of the lower body portion B is adapted to be rotated to effect switching operation as will be mentioned in detail later. A motor 3 and a cell 4 are mounted inside the water-tight lower body portion B. A rotary shaft 5 of the motor 3 has an end portion extending outwardly from a rear end of the lower body portion B, and a propeller 6 is connected to the rearmost end of the shaft 5. A switch contact 7 is provided at a given position in the lower body portion B. The switch contact 7 is adapted to be connected or disconnected according to the rotation of the head 11 to close or open a circuit between the motor 3 and the cell 4. At the rear of the propeller 6 are provided a vertical rudder 8 and the second horizontal rudder 9 fixed so as to have a pressure of water at the lower face thereof when cruising in the water. The upper body portion A and the lower body portion B are coupled each other through an engagement between a connecting portion 10 formed at the bottom of the upper body portion A and a projected portion formed at the top of the lower body portion B.

Figure 4:
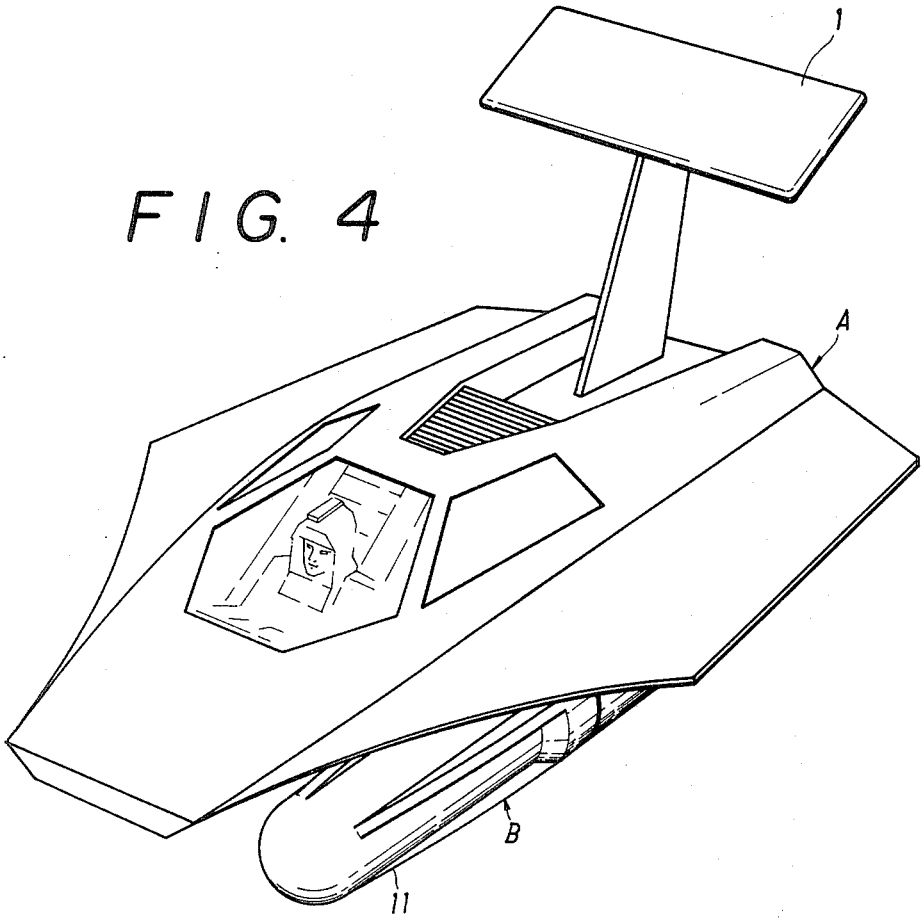
FIG. 4 is a perspective view of another form of a submersible toy in accordance with the present invention.
Figure 5:
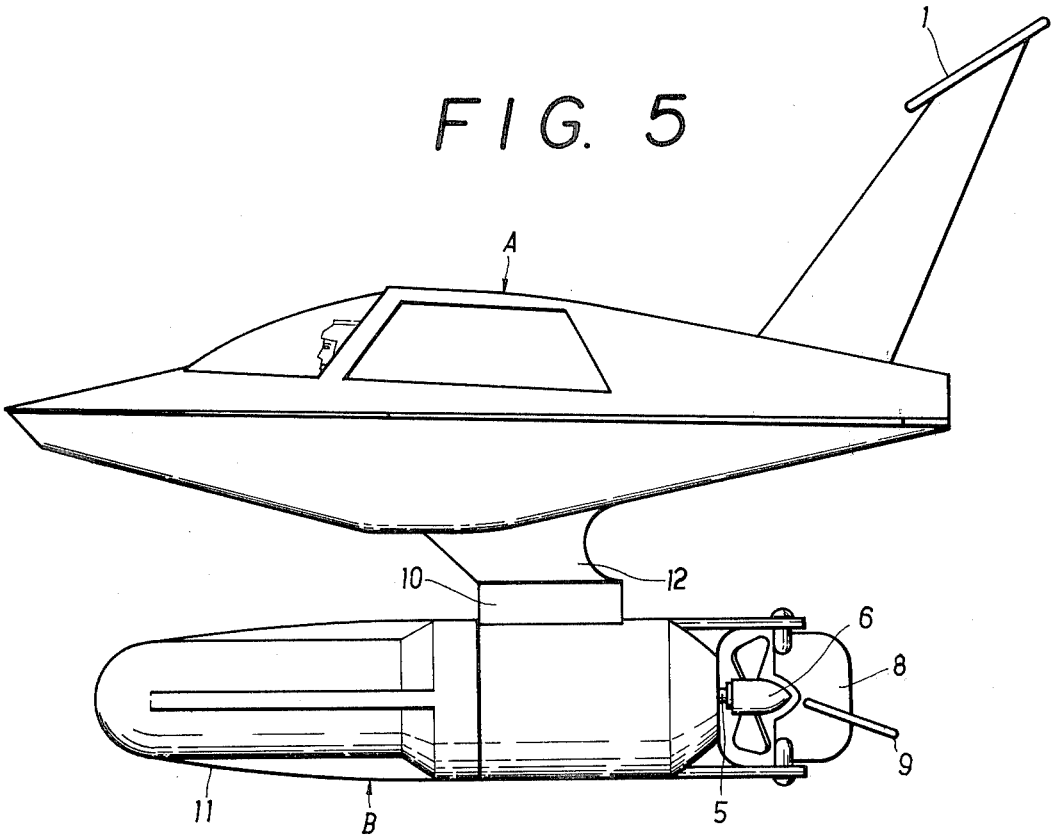
FIG. 5 is a side elevational view of the submersible toy illustrated in FIG. 4.

Although the upper body portion A is formed in a whale-shape in the embodiment illustrated in FIGS. 1 to 3, it may be formed in a ship shape as illustrated in FIGS. 4 and 5 or in another animal-shape, a fish-shape, etc. The float is preferably made of expanded polystyrene, hollow plastics, etc. to constantly maintain a desired bouyancy. The method to connect the upper body portion A to the lower body portion B is not limited to the method as referred to above, but may be any other method ordinarily employed for toys of this type. For example, a connecting portion may alternatively be provided in the lower body portion B which is adapted to be engaged with a matable projection provided in the upper body portion A as illustrated in FIG. 5. Further, the closing and opening operation of the circuit between the motor 3 and the cell 4 may be effected by any other method than that disclosed herein, so long as the desired effect can be obtained.

In the so constructed submersible toy of this invention, it will be seen that when the head 11 of the lower body portion B is rotated on the surface of the water to close the switch contact 7, the motor 3 starts to rotate to drive the propeller 6. Upon rotation of the propeller 6, the entire body drives forwardly. Then, the second horizontal rudder 9 receives a pressure of water on the lower face thereof so that the body begins to go downwardly, i.e., dive under water. When the body goes so deep that the first horizontal rudder 1 is submerged under water, a water pressure is also applied to the upper face of the rudder 1 and the body begins to go upwardly in cooperation with the bouyancy of the float 2. As a result, the head portion of the body A surfaces and then the rudder 1 breaks the surface. In this state the pressure on the upper face of the rudder 1 is eliminated, so that the body begins to dive again by the action of the water pressure on the second horizontal rudder 9. Thus, cruising under water and on the surface are continuously repeated.

In this connection, it is to be noted that the diving time, i.e., the time the body is submerged under water is adjustable by varying the distance between the horizontal rudders 1 and 9 provided on the upper body portion A and the lower body portion B, respectively. More specifically, where the distance between the rudders 1 and 9 is reduced, the diving time becomes shorter. On the other hand, where they are remoted from each other any more, the diving time is made longer.

As mentioned above, the invention can provide a very interesting toy which is capable of repeatedly cruising under water and on the surface.

I claim:

1. A submersible toy comprising:

an upper body portion;

a liquid-tight lower body portion;

said upper body portion being coupled to said lower body portion through connecting means;

a first horizontal rudder provided on said upper body portion;

a second horizontal rudder provided on said lower body portion;

said first horizontal rudder on the upper body portion being disposed at a position substantially vertically above said second horizontal rudder on the lower body portion;

a float provided inside said upper body portion;

a motor and a cell provided inside said liquid-tight lower body portion;

said motor having a rotary shaft which has an extension projected outwardly from a rear portion of said lower body portion;

a propeller provided on the extension of the rotary shaft; and a vertical rudder provided on said lower body portion at the rear of said propeller;

said second horizontal rudder on the lower body portion being disposed at the rear of said propeller.

2. A submersible toy as set forth in claim 1, wherein said first horizontal rudder acts as a rising rudder and said second horizontal rudder acts as a diving rudder.

3. A submersible toy as set forth in claim 1, wherein a head portion of said lower body portion is rotatable and which further comprises a switch contact provided inside said lower body portion and adapted to be closed upon rotation of said head portion of the lower body portion to electrically connect the cell to the motor.

4. A submersible toy as set forth in claim 1, wherein said float is made of a material selected from a group consisting of expanded polystyrene and hollow plastics.

* * * * *